US007076831B1

(12) United States Patent
Ji et al.

(10) Patent No.: US 7,076,831 B1
(45) Date of Patent: Jul. 18, 2006

(54) DEVICE FOR EXHAUSTING IN VACUUM CLEANER

(75) Inventors: Heon Pyeong Ji, Pusankwangyok-shi (KR); Sang Jun Park, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/088,134

(22) PCT Filed: Mar. 15, 2000

(86) PCT No.: PCT/KR00/00215

§ 371 (c)(1),
(2), (4) Date: Mar. 15, 2000

(87) PCT Pub. No.: WO01/19227

PCT Pub. Date: Mar. 22, 2001

(30) Foreign Application Priority Data

| | | |
|---|---|---|
| Sep. 16, 1999 | (KR) | 1999/39932 |
| Jan. 11, 2000 | (KR) | 2000/01214 |
| Mar. 8, 2000 | (KR) | 2000/11580 |

(51) Int. Cl.
*A47L 9/12* (2006.01)

(52) U.S. Cl. ..... 15/347; 15/327.7; 15/327.1; 55/DIG. 3

(58) Field of Classification Search ..... 15/327.2, 15/327.7, 347, 412, 413; 55/DIG. 3
See application file for complete search history.

(56) References Cited

U.S. PATENT DOCUMENTS

| | | | | |
|---|---|---|---|---|
| 4,545,794 | A * | 10/1985 | Himukai | 15/327.7 |
| 4,809,394 | A * | 3/1989 | Suka et al. | 15/327.2 |
| 4,970,753 | A * | 11/1990 | Herron, Jr. | 15/327.2 |
| 5,946,771 | A * | 9/1999 | Bosyj et al. | 15/347 |

FOREIGN PATENT DOCUMENTS

| | | |
|---|---|---|
| JP | 8-252196 | * 10/1991 |
| JP | 05-042070 | 2/1993 |
| KR | 1988-0011613 | 8/1988 |
| KR | 1991-0003974 | 3/1991 |
| SU | 1653730 | * 6/1991 |

* cited by examiner

*Primary Examiner*—Theresa T. Snider
(74) *Attorney, Agent, or Firm*—Harness, Dickey & Pierce, P.L.C.

(57) ABSTRACT

An exhaust system for a vacuum cleaner where filtered air is directed outside the main body of the vacuum cleaner through exhaust holes formed in at least one of a plurality of supporting wheels rotatably mounted to both sides of the main body. The disclosed exhaust system provides an improved aesthetic appearance in a structurally efficient design.

21 Claims, 13 Drawing Sheets

DEVICE FOR EXHAUSTING IN VACUUM CLEANER

This application is the national phase under 35 U.S.C. § 371 of PCT International Application No. PCT/KR00/00215, which has an International filing date of Mar. 15, 2000, which designated the United States of America

TECHNICAL FIELD

The present invention relates to a vacuum cleaner, and more particularly, to a device for exhausting air from inside a vacuum cleaner to the exterior thereof.

BACKGROUND ART

Generally, a vacuum cleaner generates a suction force for picking up dirt and debris, such as dusts and other particulate matter. The suction force is created by a flow of air between an intake port and exhaust port and that travels through the interior of the vacuum cleaner.

Referring to FIGS. 1 and 2, the vacuum cleaner 1 creates a suction force by generating a continuous air flow through various constituent parts of the vacuum. The vacuum cleaner 1 uses an electric motor to create an air flow that is directed toward an exhaust port resulting in a pressure drop on the intake side of the motor. This pressure drop creates a suction force, or an air flow, at the intake port that is used to pick up dirt and debris. Dirt and debris suspended in the air flow are carried into the vacuum and pass through a filter or filters as the air flow is exhausted into the atmosphere.

The vacuum cleaner 1 includes a main body 10. A fan 13, rotated by a driving force of a motor, is mounted inside the main body 10 for creating the air flow described above. The intake side of the vacuum includes a suction nozzle 20 connected to the main body 10 by a suction hose 31, a grip portion 32, and an extension pipe 33. These elements are sequentially connected between the suction nozzle 20 and the main body 10 for guiding the air flow with foreign matters drawn through the suction nozzle 20 into the main body 10.

The air which is drawn to inside of the main body 10 of the vacuum cleaner 1 passes through dust collecting bag 11 that filters the dirt and debris from the air as it migrates through the vacuum. Once filtered, air is then exhausted through a plurality of exhaust holes 14 formed at rear of the main body 10. An air exhaust filter 15 is mounted at an inner part of the main body 10 across the plurality of exhaust holes 14 to collect fine dusts contained in the air exhausted through each of the plurality of exhaust holes 14.

To promote ease of movement, the main body 10 has a plurality of wheels 16 that are rotatably mounted on both sides of the main body 10. The mounting structure of each of the wheels 16 is shown in FIGS. 3 and 4. Each of the wheels 16 is connected to the main body 10 using a combination of supporting elements. As shown in the drawings, each of the plurality of wheels 16 include a hook 16*a*, formed near the center rotational axis of the wheel 16, and a projected locking portion 10*a*, for mounting the hook 16*a* thereto, that is formed at the outer surface of the main body 10.

However in conventional vacuum cleaners, the aforementioned wheels 16 are merely used for the sole purpose of facilitating the easy movement of the main body 10, and do not have any other functions.

Additionally, the air exhaust filter 15 must be frequently replaced with a clean filter to ensure that dirt and debris trapped in the filter does not impede air flow created by the vacuum. In a conventional vacuum, it was quite cumbersome for a user to replace the air exhaust filter which requires the user, in some systems, to disassemble the entire vacuum cleaner for replacing the air exhaust filter.

Further, while the functions and designs of a vacuum cleaner have been recently improved, the aesthetic appearance has not. In particular, the plurality of exhaust holes 14 formed at rear of the main body 10 are visually unappealing because of user perception that the air inside the vacuum cleaner is exhausted thereto.

SUMMARY OF THE INVENTION

Accordingly, the present invention is directed to an exhaust system in a vacuum cleaner that substantially obviates one or more of the problems due to limitations and disadvantages of the related art.

An object of the present invention is to provide a device for exhausting air from a vacuum cleaner in which an air exhaust filter can be easily replaced.

Another object of the present invention is to provide a device for exhausting air from a vacuum cleaner with a visually appealing aesthetic appearance that masks the exhaust holes by incorporating them into other structural features of the vacuum.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the device for exhausting air from a vacuum cleaner includes a main body for suction and collecting of various contaminants, wheels rotatably mounted at both sides of the main body, an exhaust flow passage formed between the main body and the wheels for discharging the filtered air from the main body, and an air exhaust filter provided at the exhaust flow port for filtering dirt and debris.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
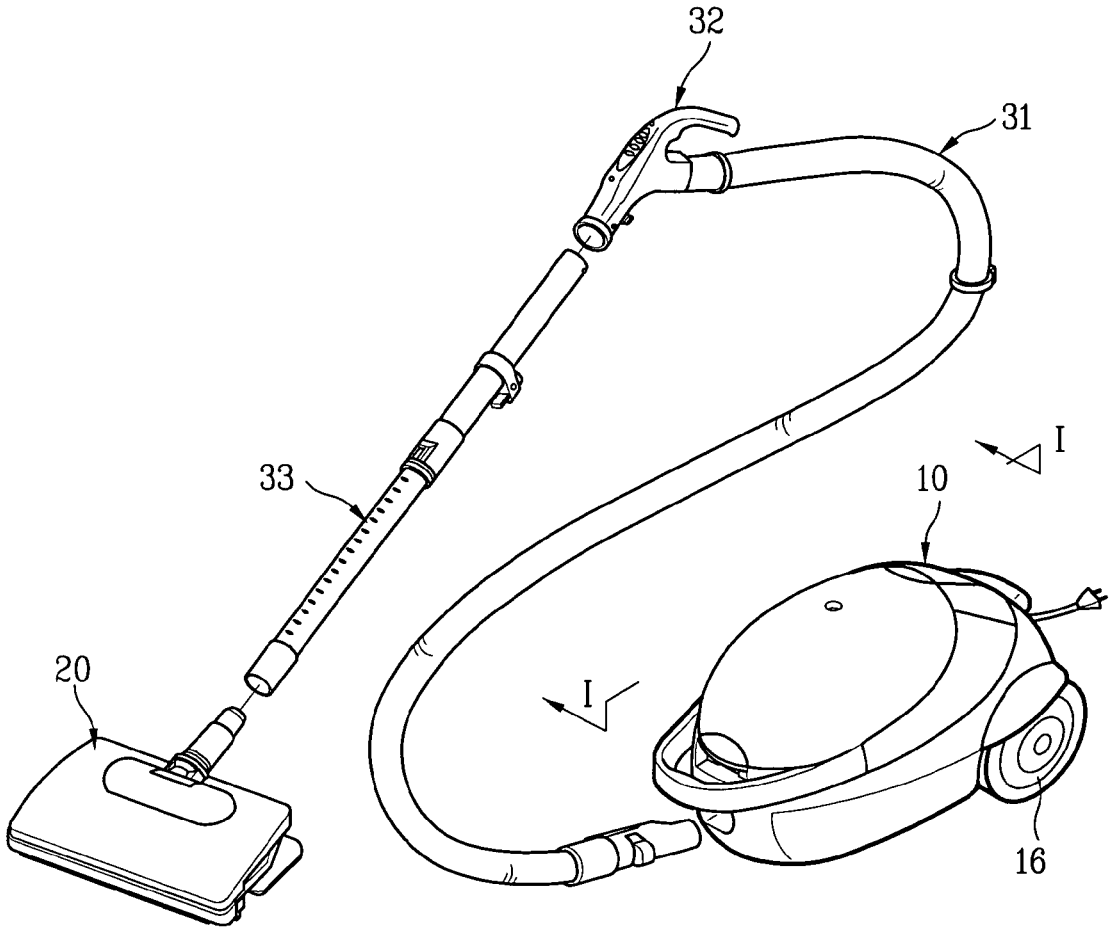
FIG. 1 Prior Art
FIG. 1 is a perspective view of a conventional vacuum cleaner.
Figure 2:
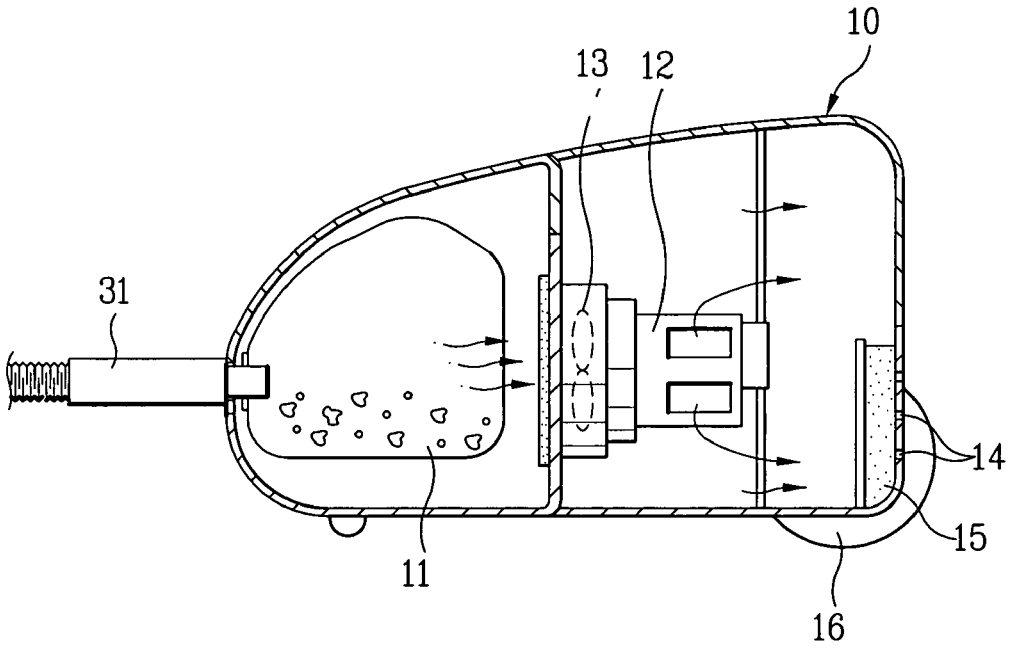
FIG. 2 Prior Art
FIG. 2 is a cross-sectional view showing the interior of a conventional vacuum cleaner.
Figure 3:
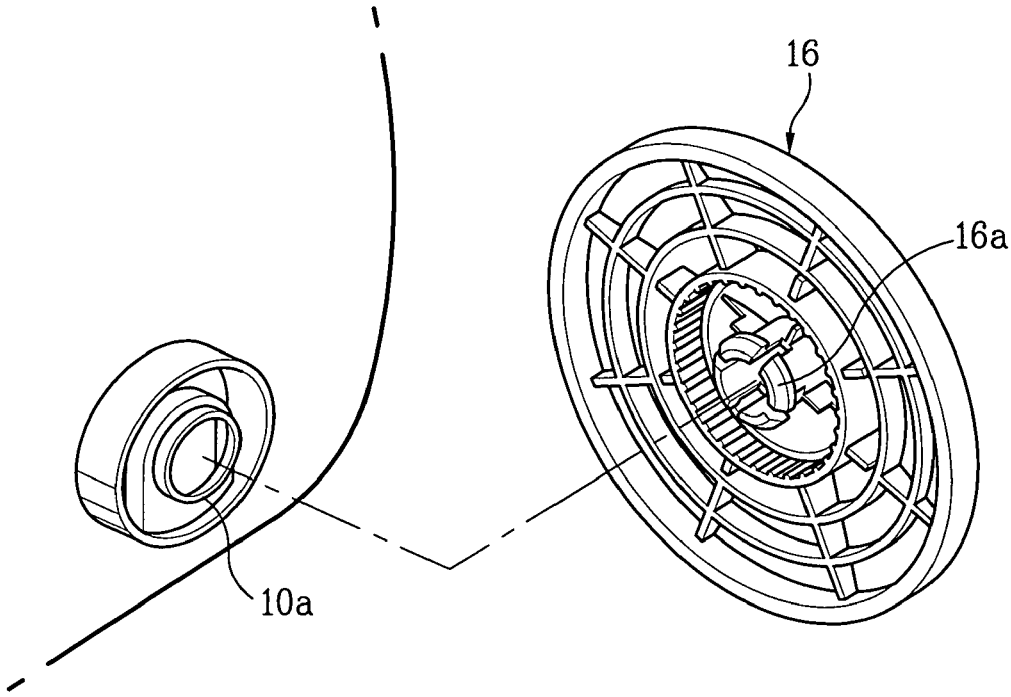
FIG. 3 Prior Art
FIG. 3 is a disassembled perspective view showing a structure for mounting a wheel to the main body of a conventional vacuum cleaner.
Figure 4:
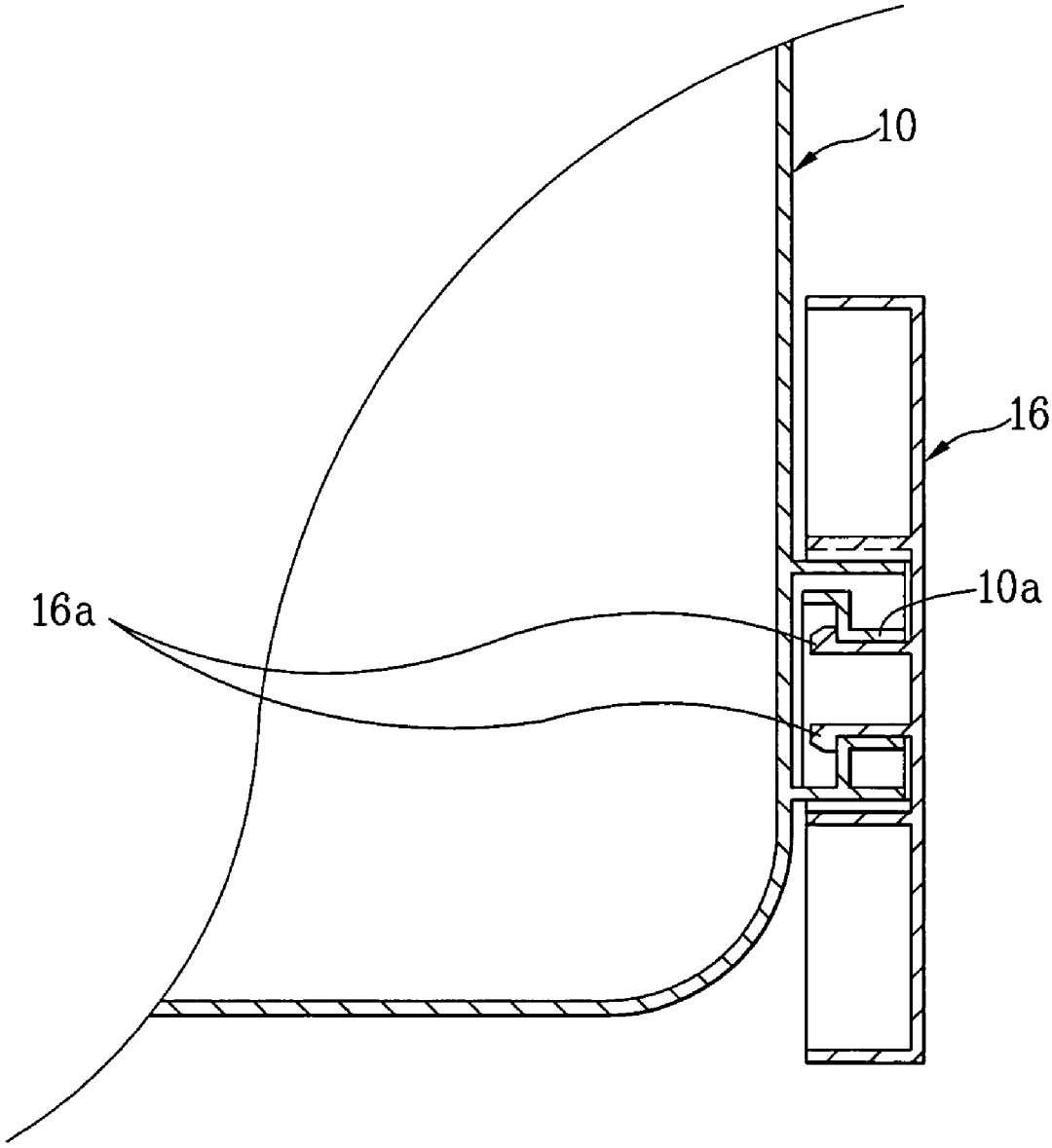
FIG. 4 Prior Art
FIG. 4 is a cross-sectional view showing a wheel and the structure for mounting a wheel to a conventional vacuum cleaner of FIG. 3 connected to a main body of a vacuum.
Figure 5:
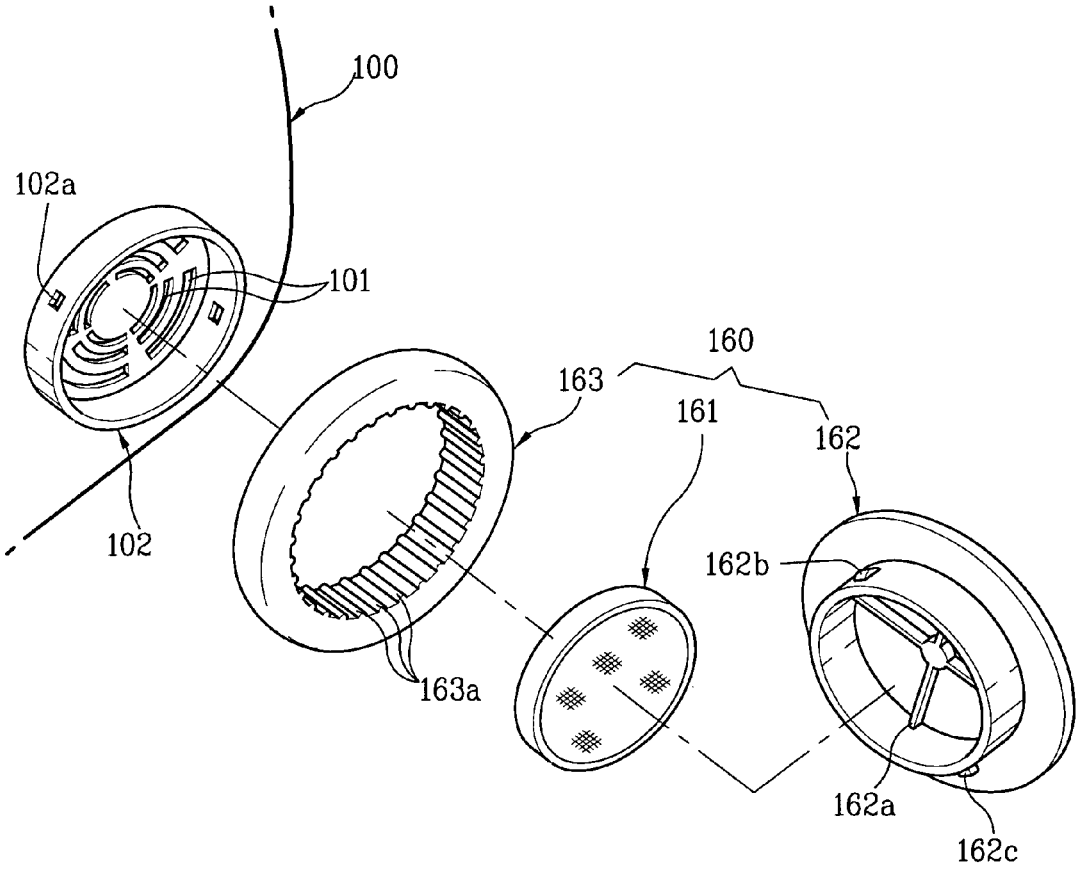
FIG. 5 is a disassembled perspective view showing an exhaust device for a vacuum cleaner in accordance with a first embodiment of the present invention.

FIG. 5 is a disassembled perspective view showing an exhaust device for a vacuum cleaner in accordance with a first embodiment of the present invention that includes an exhaust device that combines a wheel with an exhaust filter.

While only one wheel 160 is shown and described with respect to the first preferred embodiment, a second conventional wheel is disposed on the opposing side of the main body 100.

A guiding projection 102 is formed about an exhaust hole 101 in the outer surface of the main body 100. The guiding projection 102 is circular shaped and surrounds a plurality of exhaust holes 101 formed in the main body 100. While the exhaust holes 101 are shown as being arcuate shaped, other hole configurations may be equally as effective in promoting air flow. The guiding projection includes a supporting rim that projects from the main body 100 for receiving and for supporting elements of the wheel 160.

The wheel 160 includes a guiding member 162 for housing an air exhaust filter 161 and for supporting rolling movement of a rolling member 163. The guiding member 162 includes a rim that projects from a circular member. The rim of the guiding member 162 has a diameter that permits a portion of the rim to securely fit within the rim of the guiding projection 102 that together support rotating movement of the rolling member 163.

The guiding member 162 includes a rib 162*a* that projects from the center of the rim to its inner surface. The rib 162*a* defines a plurality of openings that promote air flow through the wheel 160 when engaged with the guiding projection 102 and main housing. The rib 162*a* of the guiding member also assists in securely holding the air exhaust filter 161 to prevent detachment and shaking.

The air exhaust filter 161 has a circular shape that fits in a holding chamber defined by the combination of the guiding member 162 and guiding projection 102.

The rolling member 163 has a plurality of projections 163*a* along an inner circumference thereof that enable it to slide around the supporting structure. The rolling member 163 is preferably made of a soft pliable material, such as rubber, for smooth contact and rolling on a variety of surfaces, such as carpet, hardwood flooring or linoleum. However, the rolling member 163 may also be formed of other comparatively lesser soft materials such as plastic and metal.

The wheel is held together by a system that also holds the filter between the guiding projection 102 and the guiding member 162. The locking hole 102*a* formed in the rim of the guiding projection 102 receives the protrusion 162*b*, formed in an outer circumference of the rim of guiding member 162. At the same time, the hook 162*c* of the guiding member 162 engages a corresponding locking hole 102*a* of the guiding projection 102, so that the wheel 160 and the main body 100 are connected with each other in a locked condition.

The protrusion 162*b* and hook 162*c* are preferably formed along the circumference of the guiding member 162 for maintaining a secure connection between the main body 100 and the wheel 160, and at the same time, for providing a mechanism for easily detaching the wheel 160 from the main body 100 when necessary.

The disclosed wheel 160 functions as an exhaust port to promote the free flow of air from the dust collecting bag to outside the main body 100 that replaces the exhaust holes formed at the rear of the main body 100 of a conventional vacuum cleaner.

Figure 6:
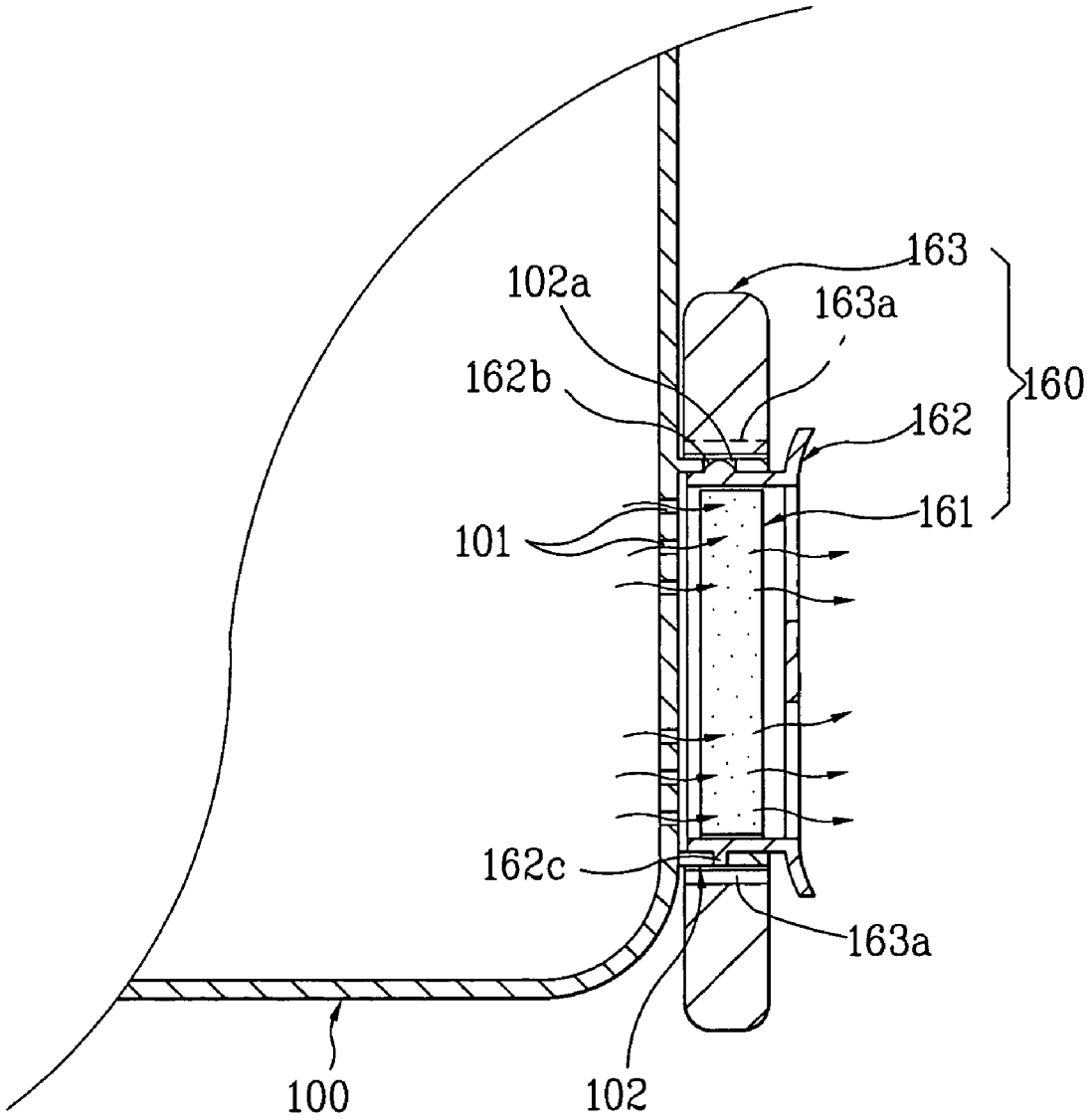
FIG. 6 is a cross-sectional view of the exhaust device of FIG. 5 with a wheel mounted to the main body of a vacuum in accordance with a first embodiment of the present invention.

FIG. 6 is a sectional view showing the main parts of a wheel 160 connected to the main body 100 in accordance with a first embodiment of the present invention.

As shown in FIG. 6, the air exhausting filter 161 is fixed between an outer surface of the main body 100, in which the exhaust holes 101 are formed, and the guiding member 162. The guiding member 162 is being connected to the guiding projection 102 formed at the main body 100 to be fixed thereto by cooperative engagement of the protrusion 162*b* and hook 162*c* with the guiding projection 102 and locking hole 102*a*. The rolling member 163 is rotatably connected to an outer circumference of the guiding member 162 when connected with the guiding projection 102.

The operation of the first embodiment of the present invention will be explained in detail.

First, a motor rotates a fan creating an air flow on the backside of the fan that results in air flow on the intake side of the vacuum, i.e. a suction force. Air and dusts pass through the suction nozzle 20, the extension pipe 33, the grip portion 32 and the suction hose 31, to be drawn into the dust collecting bag 11 provided within the main body 100. Then, once filtered air passes the dust collecting bag 11 and flows inside the main body 100, the air flowing inside the main body is exhausted to outside of the main body 100 through the plurality of exhaust holes formed at one side of the main body 100 through the wheel 160. Accordingly, air is filtered a second time as it passes through exhaust filter 161 housed within the wheel 160.

When replacing the air exhaust filter 161 with a new one, the guiding member 162 connected to the guiding projection 102 of the main body 100 is simply detached thereby providing easy access to air exhaust filter 161.

A second preferred embodiment will now be described with reference to FIGS. 7 and 8 that shows an exhaust device in accordance with a second embodiment of the present invention having a structure that allows the air exhaust filter 161 to be easily mounted and replaced. With the exception of the structure described below, other parts in the structure are the same as those of the first embodiment.

Figure 7:
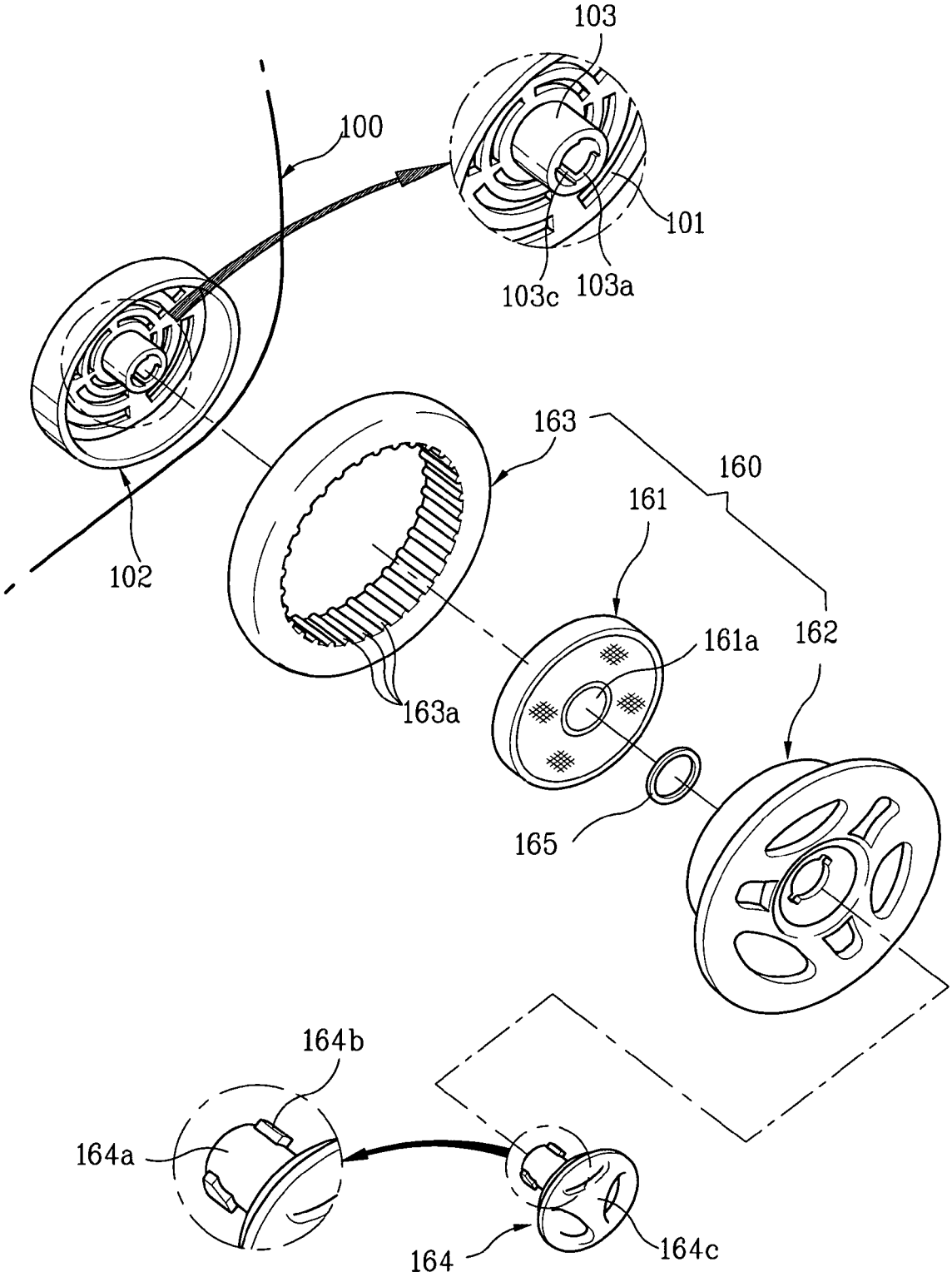
FIG. 7 is a disassembled perspective view showing an exhaust device for a vacuum cleaner in accordance with a second embodiment of the present invention.
Figure 8:
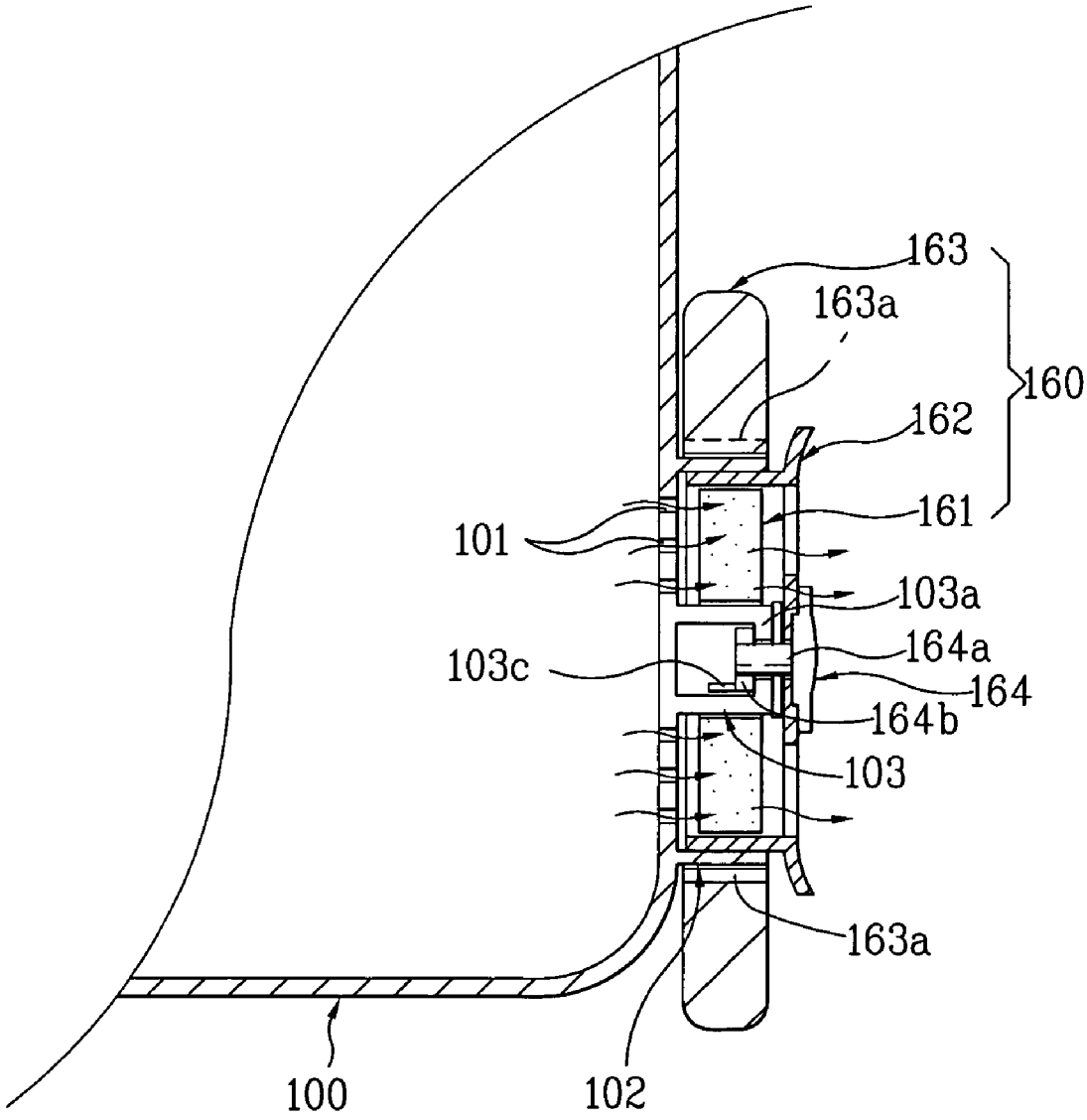
FIG. 8 is a cross-sectional view of the exhaust device of FIG. 7 with a wheel mounted to the main body of a vacuum in accordance with a second embodiment of the present invention.

As shown in FIG. 7, a projected center axis 103 is integrally formed at a side of the main body 100 surrounded by a plurality of exhaust holes 101. The projected center axis is formed to penetrate corresponding apertures in both the air exhaust filter 161 and the guiding member 162 of the wheel 160. A grip portion 164 is mounted at an outer side of the guiding member 162 of the wheel 160 for connecting to the center axis 103 to fix the guiding member 162 to the guiding projection 102.

In the aforementioned structure, the grip portion 164 replaces the locking mechanism described in the first embodiment. The protrusion 162*b* and the hook 162*c* formed at the outer circumference of the guiding member 162, and the locking hole 102*a* which was formed at the outer circumference of the guiding projection 102 are not necessary in accordance with the second embodiment of the present invention. That is, an end portion of the center axis 103 which is projected outwardly of the guiding member 162 is formed as a cylindrical shape having an empty space therein, and locking portions 103*a* are integrally formed along an inner circumference facing each other, to be projected inwardly of the center axis.

A connecting axis 164*a* which is inserted inside of the center axis 103 is formed at the grip portion 164. The connecting axis 164*a* is provided with locking protrusions 164*b* which engage the locking portion 103*a* of the center axis 103 when the connecting axis 164*a* is inserted into the center axis 103 for preventing detachment thereof. The combined structure provides a secure and easily accessible mechanism for mounting the air exhaust filter 161 within the wheel 160.

Each locking protrusion 164*b* of the grip portion 164 has an inclined surface whose width narrows toward a rear of the grip portion 164. That is, when the locking protrusion 164*b* is located within the locking portion 103 and the grip portion 164 is rotated, the locking portion 103*a* passes the inclined surface of the locking protrusion 164*b* and is located at an inner portion thereof, thereby guiding the grip portion 164 to be completely inserted inside the center axis 103. Since a gap between the locking protrusion 164*b* and a packing member 165 is narrower than the thickness of the locking portion 103*a*, the locking portion 103*a* is compressed between the locking protrusion and the packing member 165.

A projected rotation preventing portion 103*c* is additionally formed axially at one end of the locking portion 103*a*, for limiting the rotation range of the grip portion 164.

A packing member 165 is positioned on the connecting axis 164*a*, between an inner wall of the guiding member 162 and the locking protrusion 164*b* of the grip portion 164 for sealing a gap there between. The packing member 165 is preferably formed of a comparatively flexible material, for sealing the gap at its maximum.

The procedure of mounting the air exhaust filter having the aforementioned structure in accordance with the second embodiment of the present invention will be explained in detail.

First, the center axis 103 penetrates the air exhaust filter 161 as it projects from an inner part of the guiding projection 102 at a side of the main body 100. The guiding member 162 is mounted on the center axis 103 and moves against the guiding projection 162 to form a chamber for holding the air exhaust filter 161. The air exhaust filter 161 can be easily mounted since hole 161*a* is formed at the center of the air exhaust filter 161 for easy alignment with the center axis 103.

The connecting axis 164*a* of the grip portion 164 is then inserted into the center axis 103 which is exposed through the center portion of the guiding member 162, and the grip portion 164 is rotated to complete the connection. That is, when the grip portion 164 is rotated, the locking portion 103*a* formed at the center axis 103 passes the inclined surface of the locking protrusion 164*b* formed around the connecting axis 164*a* of the grip portion 164, and is gradually moved to an inner part of the locking protrusion 164*b* to be closer to a inner surface of the guiding member 162.

The packing member 165 mounted between the locking protrusion 164*b* and the guiding member 162 is gradually compressed to seal the space there between and produce a force to secure the connection of the locking protrusion 164*b* and the guiding member 162. When in this position, the fixing force of the packing member 165 prevents further rotation of the grip portion 164.

Continuous rotation of the grip portion 164 causes the locking protrusion 164*a* to engage the rotation prevention portion 103*c* formed at the inner wall of the center axis 103 placing the wheel 160 in a locked condition.

Figure 9:
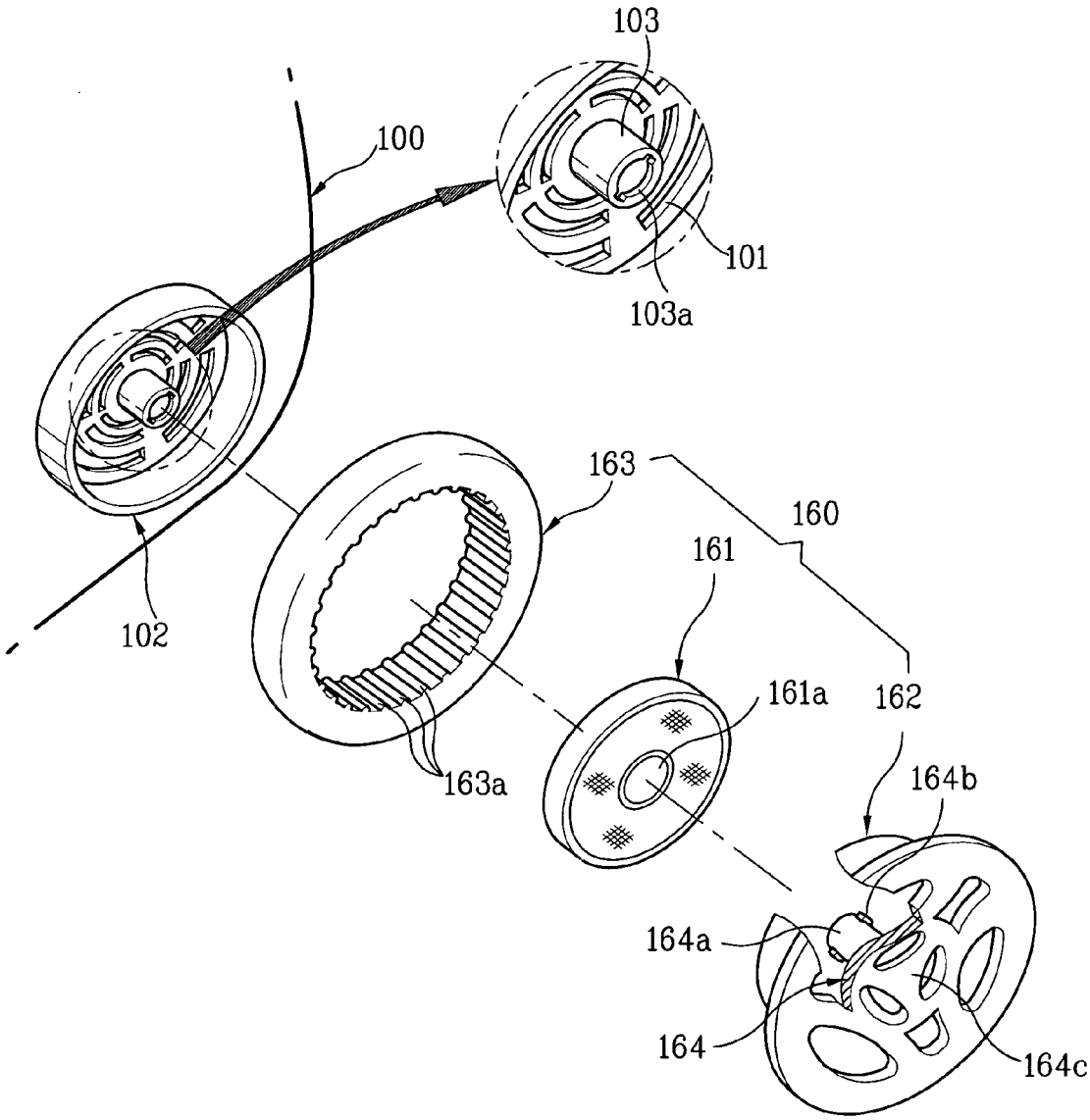
FIG. 9 is a disassembled perspective view showing a main part of a variation of a grip portion in accordance with the second embodiment of the present invention.

A variation of the grip portion of the second embodiment is shown in FIG. 9. As shown there, a projected, substantially A shaped grip portion protrusion 164*c* is formed on an exterior surface of the guiding member 162 to assist a user in firmly gripping the grip portion protrusion 164*c*. The shape of the grip portion protrusion 164*c* is not limited to have the aforementioned shape, but can be formed in other shapes to promote a secure grip such as a "+" or an "I" shape.

Figure 10:
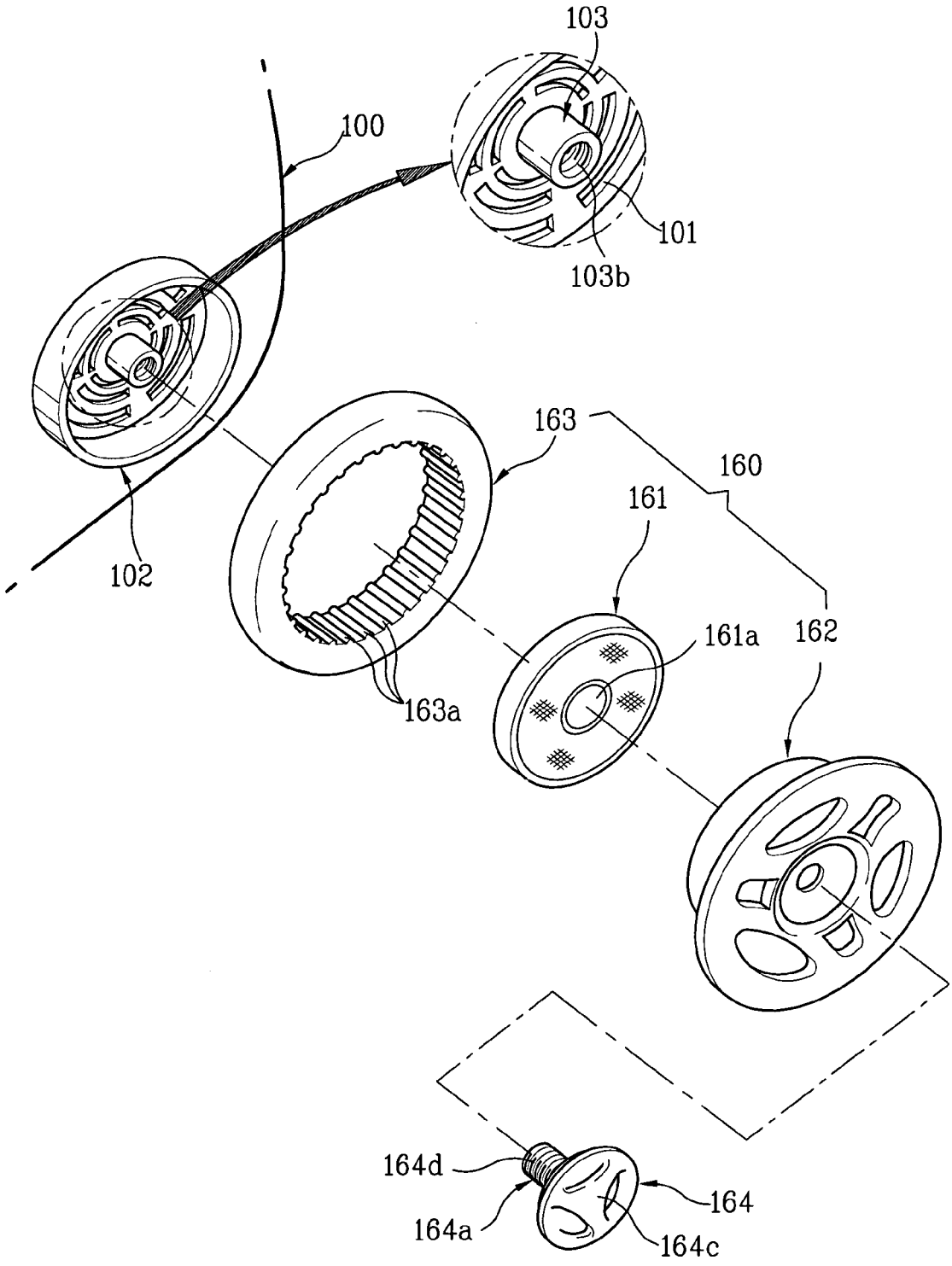
FIG. 10 is a disassembled perspective view showing an exhaust device for a vacuum cleaner in accordance with a third embodiment of the present invention.
Figure 11:
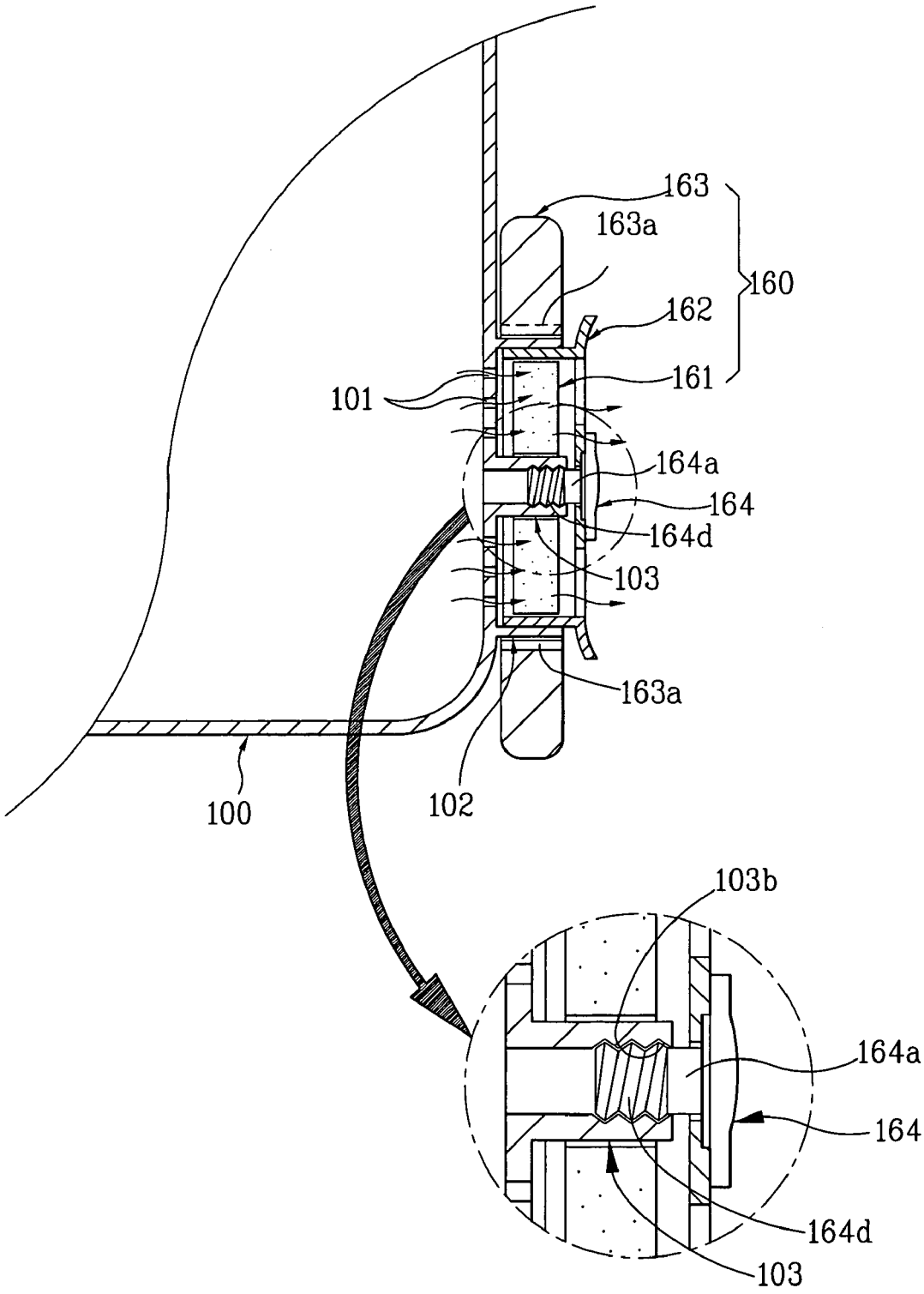
FIG. 11 is a cross-sectional view showing each component of FIG. 10 in an assembled state in accordance with a third embodiment of the present invention.

A third preferred embodiment will now be described with reference to FIGS. 10 and 11 that show a connecting relationship between the center axis formed at a side of the main body 100 and a separate grip portion.

The structure of the third embodiment is similar to that of the second embodiment, except with respect to the connecting relationship between the center axis and the grip portion. That is, a plurality of screw threads 103*b* are formed along an inner circumference of an aperture in the center axis 103 that is designed to receive a projected connecting axis 164*a* having corresponding screw threads 164*d* formed along its outer circumference is formed in the grip portion 164, thereby enabling easy mounting of the air exhaust filter 161.

The procedure of mounting the air exhaust filter 161 in accordance with the third embodiment of the present invention will be explained in detail.

First, the air exhaust filter 161 is mounted on the center axis 103, and the guiding member 162 is mounted against the outer circumference of the air exhaust filter 161. The hole 161*a* is formed at the center of the air exhaust filter 161 to receive the center axis 103 allowing the air exhaust filter 161 is be easily mounted as described above.

The connecting axis 164*a* of the grip portion 164 is then inserted into the center axis 103 which is exposed through the center portion of the guiding member, and the grip portion 164 is rotated to complete the connection by causing the corresponding screw threats to pull the constituent elements together in a secured relationship.

A projected, substantially Λ shaped grip portion protrusion 164*c* is formed on an exposed surface of the grip portion to promote a more secure grip by the user. The grip portion protrusion 164*c* is not limited to have the aforementioned shape, but can be formed in other shapes such as a "+" or an "I" shape.

Figure 12:
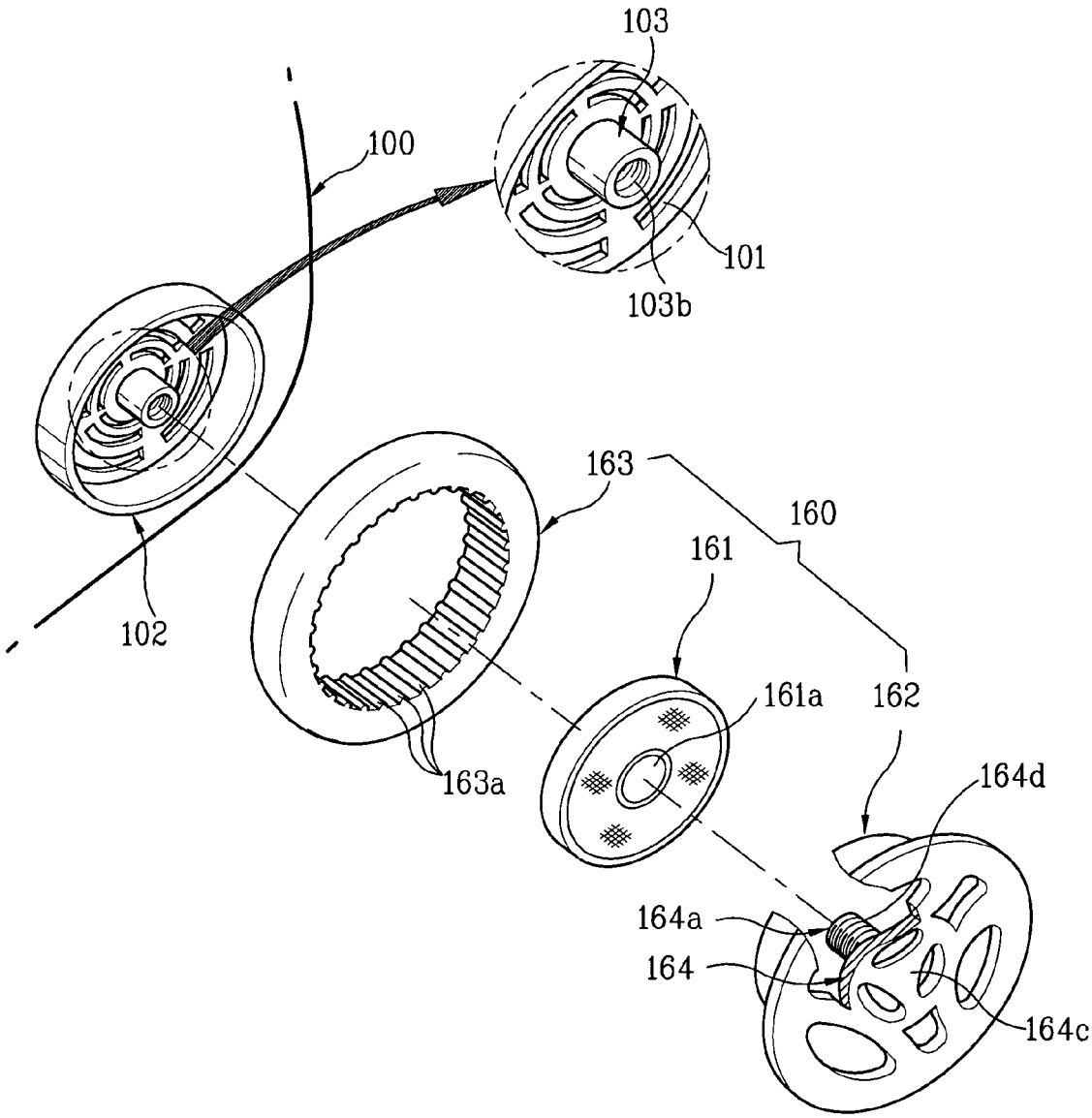
FIG. 12 is a disassembled perspective view showing a main part of a variation of a grip portion in accordance with the third embodiment of the present invention.

FIG. 12 shows a modified version of the third preferred embodiment where the grip portion 164 is integrally formed as part of the guiding member 162.

The air exhaust filter 161 may be easily removed from the wheel 160 by rotating the grip portion 164 out of engagement with the center axis. Once the guiding member 162 is separated from the center axis 103, the air exhaust filter 161 may be removed.

With the aforementioned embodiments, the exhaust holes 101 are integrally formed as part of the main body 100. However, a situation may occur where the exhaust holes become blocked with debris. For example, fine dusts passing through each of the exhaust holes 101 of the main body 100 may collect in the exhaust holes as a result of moisture that passes through the vacuum or that is introduced from the outside. When this occurs, a user must wipe or clean the entire side portion of the main body 100 to remove the contaminants thereof. Further, it may be difficult or impossible to fully clean the exhaust holes from the exterior of the main body 100 without potentially exposing internal circuitry and systems of the vacuum to water or other cleaning solutions.

Figure 13:
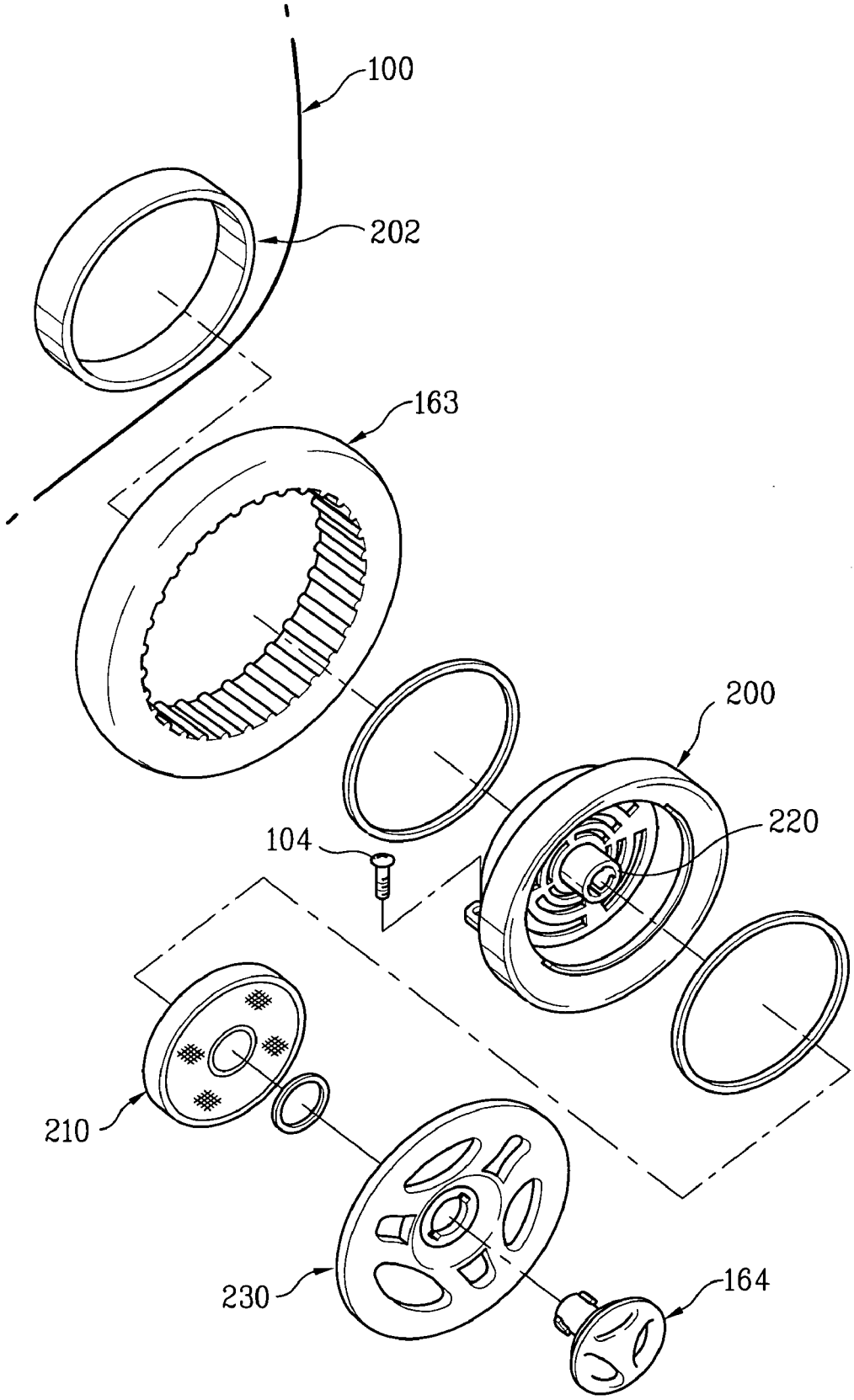
FIG. 13 is a disassembled perspective view showing an exhaust device for a vacuum cleaner in accordance with a fourth embodiment of the present invention.
Figure 14:
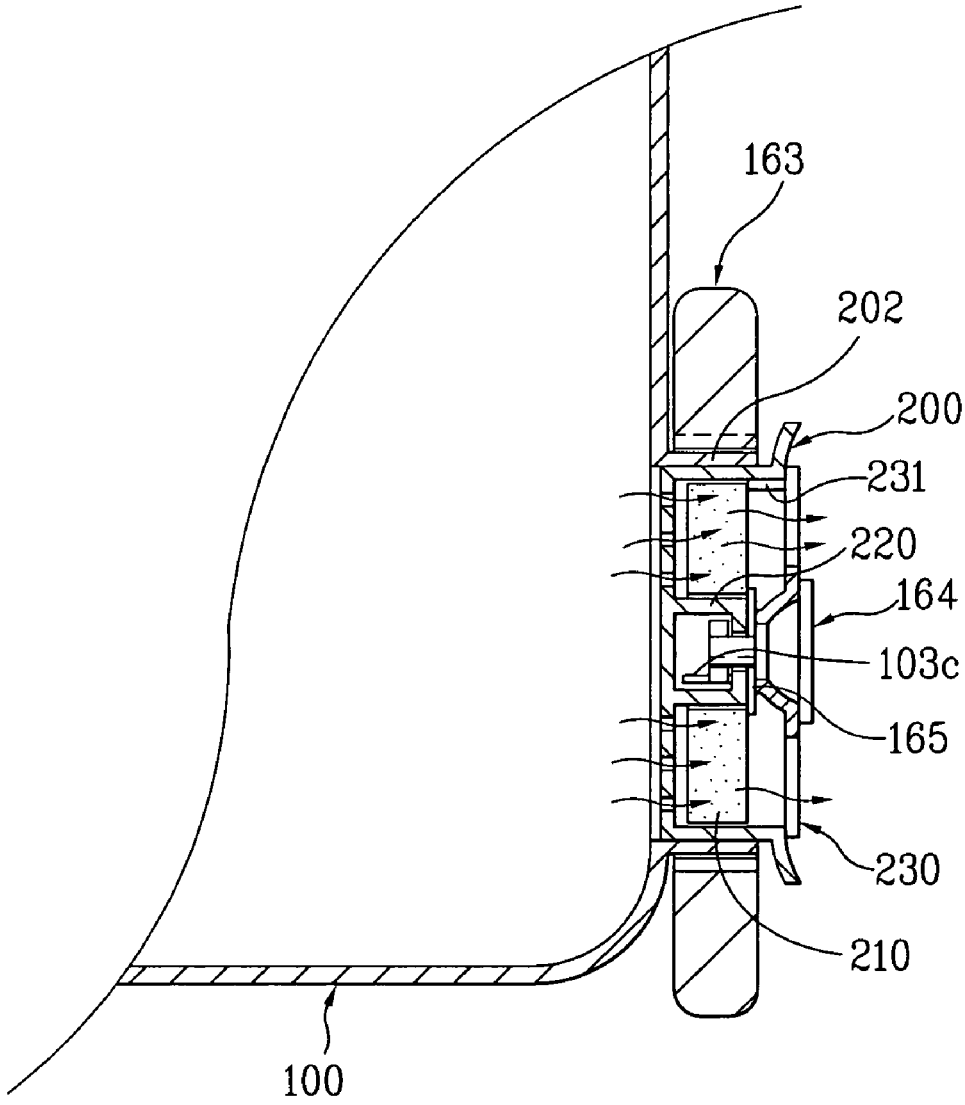
FIG. 14 is a cross-sectional view showing each component of FIG. 13 in an assembled state in accordance with a fourth embodiment of the present invention.

FIGS. 13 and 14 show a fourth embodiment of the present invention to solve the aforementioned problem.

The fourth embodiment in accordance with the present invention includes an exhaust system in which a side portion of the main body 100 is completely open without exhaust holes. A guiding projection 202 has an outer circumference that projects from the main body 100 and around an opening in the main body 100. A portion of the guiding projection supports the rolling member 163. A separate filter assembly 200, having an air exhaust filter 210, is mounted between the guiding projection 202 and guiding member 230 to form the wheel.

The filter assembly 200 is securely fixed to the main body 100 of the vacuum cleaner. In the illustrated embodiment, a bolt is used. However, securing devices may also be used.

The filter assembly 200 includes center axis 220 which penetrates and supports the air exhaust filter 210. A guiding member 230 for supporting the air exhaust filter 210 is mounted at the center axis 220 to prevent detachment of the air exhaust filter 210. When assembled, the guiding member 230 is moved against the filter assembly 200 using the grip portion 164 in a manner as described with respect to the aforementioned embodiments. Rotation prevention portions 231 are used for compressing the outer part of the air exhaust filter 210.

The air exhaust filter 210 in the filter assembly 200 can be replaced without disassembling the filter assembly 200.

Meanwhile, while the exhaust system of the present invention is characterized as having a wheel construction with guiding projection and guiding member, other variations of the wheel and supporting structure are possible that do not depart from the spirit and scope of the invention.

For example, a plurality of exhaust holes may be provided at each side of the main body and an air exhaust filter may be provided between the exhaust holes and the wheel.

Further, while the preferred embodiments of the exhaust system use only one wheel located on one side of the main body as an exhaust passage, multiple wheels that define multiple exhaust passages may be used. In these variations, the exhaust passage may include one or multiple wheels with filters that may be used together or in various combinations. For example, in one system, the user may sequentially use multiple wheel passages one at a time. As the filters in each wheel become blocked with debris, the blocked wheel is deactivated and a new wheel opened. This enables the user to use the vacuum even if the initial filter becomes inoperable.

The invention claimed is:

1. A device for exhausting in a vacuum cleaner, comprising:

a main body for suction and collecting contaminants from outside the main body;

an air exhaust filter for removing dust contained in the air which is discharged from inside of the main body;

a filter chamber formed in an exhaust flow passage, for containing and confining the air exhaust filter, wherein the air exhaust filter is replaceably contained in the filter chamber; and wheels mounted at both sides of the main body and defining at least one part of the filter chamber, wherein the at least one of the wheels comprises:

a guiding member detachably connected to a guiding projection formed at the side of the main body so as to replace the air exhaust filter in the filter chamber, wherein the guiding member defines a cover of the filter chamber formed inner side of the guiding projection; and a rolling member mounted around the guiding member for performing a rolling movement in supporting the main body.

2. The device as claimed in claim 1, further comprising means for locking the at least one wheel to the main body, said locking means including at least one locking hole formed near the guiding projection for receiving a corresponding locking member formed at an outer circumference of the guiding member for fixing the at least one wheel to the main body.

3. The device as claimed in claim 1, further comprising a projected part integrally formed at the side of the main body along a center axis of the guiding projection, wherein the projected part passes through the air exhaust filter; and a grip portion selectively engaging with the projected part for fixing the guiding member to the guiding projection.

4. The device as claimed in claim 3, wherein the guiding member and the grip portion are separately formed.

5. The device as claimed in claim 4, wherein an end portion of the projected part is formed as a cylindrical shape, and has a receiving aperture with locking portions formed along a surface of the receiving aperture, and a connecting part formed at the grip portion, inserted into the receiving aperture and for engaging with the locking portions, for fixing the guiding member to the filter receiver.

6. The device as claimed in claim 5, said connecting part having a plurality of locking protrusions, wherein each locking protrusion has an inclined surface whose width becomes narrow toward one end of the connecting part.

7. The device as claimed in claim 5, further comprising a packing member formed on the connecting part between an inner wall of the guiding member and the plurality of locking protrusions, for sealing a gap there between.

8. The device as claimed in claim 5, wherein each of the plurality of locking protrusions has a grip enhancing shape.

9. The device as claimed in claim 4, wherein a plurality of screw threads formed in an inner circumference of an end portion of projected part which projects outwardly of the guiding member, and a projected connecting part including a plurality of screw threads formed along its outer circumference of the grip portion, to connect the projected part and the grip portion as a screw connection.

10. The device as claimed in claim 9, wherein a grip portion protrusion is formed at the grip portion, having a shape of "+", "Λ" or "I".

11. The device as claimed in claim 3, wherein the guiding member and the grip portion are integrally formed.

12. The device as claimed in claim 11, wherein said guiding member comprises a plurality of screw threads formed in an outer surface of an end portion which is projected outwardly of the guiding member, and a projected connecting axis including a plurality of screw threads formed along its outer surface at the grip portion, to connect the center axis and the grip portion.

13. The device as claimed in claim 12, wherein a grip portion protrusion is formed at a rear side of the grip portion, having a shape of "+", "Λ" or "I".

14. A device for exhausting in a vacuum cleaner, comprising:

a main body for suction and collecting contaminants from outside the main body;

an air exhaust filter for removing dust contained in the air which is discharged from inside of the main body;

a filter chamber formed in an exhaust flow passage, for containing and confining the air exhaust filter, wherein the air exhaust filter is replaceable contained in the filter chamber; and wheels mounted at both sides of the main body and defining at least one part of the filter chamber, wherein the at least one of the wheels comprises:

a rolling member rotatably connected to an outer circumference of a guiding projection formed at the side of the main body, for performing a rolling movement in supporting the main body;

a filter receiver mounted at the guiding projection, receiving the air exhaust filter for removing dust contained in the air, and preventing detachment of the rolling member from the main body; and a guiding member located at the outside of the air exhaust filter and covering an opened side of the filter receiver so as to prevent detachment of the air exhaust filter from the filter receiver, wherein the guide member and the filter receiver define the filter chamber.

15. The device as claimed in claim 14, wherein the filter receiver comprises:

a projected part integrally formed at an inner side of filter receiver facing the guiding member along a center axis of the filter receiver, wherein the projected part passes through the air exhaust filter; and a grip portion detachably connected to the projected part for fixing the guiding member to the filter receiver.

16. The device as claimed in claim 15, wherein an end portion of the projected part is formed as a cylindrical shape, and has a receiving aperture with locking portions formed along an inner surface of the receiving aperture, and a connecting part formed at the grip portion and having locking protrusions, wherein the locking protrusions are locked to the locking portion of the projected part for fixing the guiding member to the filter receiver.

17. The device as claimed in claim 16, wherein each of said locking protrusions of the grip portion has an inclined surface whose width becomes narrow toward one end of the grip portion.

18. The device as claimed in claim 16, further comprising a packing member formed on the connecting part between an inner wall of the guiding member and the locking protrusions of the grip portion, for sealing a gap there between.

19. The device as claimed in claim 16, wherein a grip portion protrusion is formed at the grip portion which is exposed externally, having a shape of "+", "Λ" or "I".

20. The device as claimed in claim 15, wherein the guiding member and the grip portion are separately formed.

21. The device as claimed in claim 15, wherein the guiding member and the grip portion are integrally formed.

* * * * *